US006515245B2

(12) United States Patent
Marin-Pache et al.

(10) Patent No.: US 6,515,245 B2
(45) Date of Patent: Feb. 4, 2003

(54) CLOSING ASSISTANCE MECHANISM FOR AN ELECTRICAL SWITCHGEAR APPARATUS AND DRIVE MECHANISM OF AN ELECTRICAL SWITCHGEAR APPARATUS EQUIPPED WITH SUCH AN ASSISTANCE MECHANISM

(75) Inventors: Reynald Marin-Pache, Biviers (FR); Alain Bechard, Grenoble (FR); Denis Perrin, St Nicolas de Macherin (FR)

(73) Assignee: Schneider Electric Industries S.A. (FR)

( * ) Notice: Subject to any disclaimer, the term of this patent is extended or adjusted under 35 U.S.C. 154(b) by 0 days.

(21) Appl. No.: 10/005,860

(22) Filed: Dec. 7, 2001

(65) Prior Publication Data

US 2002/0092752 A1 Jul. 18, 2002

(30) Foreign Application Priority Data

Dec. 22, 2000 (FR) ..... 00 16916

(51) Int. Cl.[7] ..... H01H 5/00
(52) U.S. Cl. ..... 200/400; 200/401; 200/500
(58) Field of Search ..... 200/400, 401, 200/50.21, 50.24, 50.26, 424, 500, 501, 323, 324, 325

(56) References Cited

U.S. PATENT DOCUMENTS 3,600,541 A * 8/1971 Goodwin, Jr. ..... 200/154
4,641,001 A * 2/1987 Fujihisa et al. ..... 200/153
4,713,508 A 12/1987 Baginski et al.
5,357,066 A 10/1994 Morel et al.
6,015,959 A * 1/2000 Slepian et al. ..... 200/400
6,144,002 A 11/2000 Coudert et al.
6,184,483 B1 * 2/2001 Coudert et al. ..... 200/50.21
6,337,449 B1 * 1/2002 Brouillat et al. ..... 200/400

FOREIGN PATENT DOCUMENTS

| | | |
|---|---|---|
| EP | 0 951 123 | 10/1999 |
| FR | 2 589 626 | 10/1985 |
| FR | 2 683 089 | 10/1991 |

* cited by examiner

*Primary Examiner*—Karl D. Easthom
*Assistant Examiner*—Kyung S. Lee
(74) *Attorney, Agent, or Firm*—Parkhurst & Wendel, L.L.P.

(57) ABSTRACT

A drive mechanism of a circuit breaker comprises a master mechanism and a slave mechanism. The master mechanism is composed of an energy storage sub-assembly comprising an energy storage spring driven by a loading shaft, and an opening and closing sub-assembly driving a switching shaft. The master mechanism is controlled by a closing latch and an opening latch. The slave mechanism comprises a closing assistance spring connected to the loading shaft by means of a loading cam and a multifunctional lever. Rotation of the loading shaft loads the assistance spring and commands relaxation thereof. The assistance spring drives the switching shaft by means of an arm operating in conjunction with a crank in the form of a hook. At the end of closing travel, the arm uncouples from the crank and withdraws so as not to hamper opening of the mechanism. The assistance mechanism enables the energy delivered globally by the drive mechanism to be increased.

10 Claims, 6 Drawing Sheets

CLOSING ASSISTANCE MECHANISM FOR AN ELECTRICAL SWITCHGEAR APPARATUS AND DRIVE MECHANISM OF AN ELECTRICAL SWITCHGEAR APPARATUS EQUIPPED WITH SUCH AN ASSISTANCE MECHANISM

BACKGROUND OF THE INVENTION

The invention relates to a drive mechanism for an electrical switchgear apparatus, in particular for an electrical circuit breaker.

STATE OF THE ART

In the document FR 2,589,626 a drive mechanism of the contacts of an electrical circuit breaker is described comprising an energy storage sub-assembly and an opening and closing sub-assembly. The energy storage sub-assembly comprises an energy storage spring associated to the movable contact in such a way that relaxation of the energy storage spring drives the movable contact to its closed position, and a closing latch designed to latch the energy storage spring in a loaded state. The opening and closing sub-assembly comprises an opening spring and an opening latch designed to latch the opening spring in a loaded state. The opening spring is associated to the movable contact in such a way that relaxation of the opening spring drives the movable contact to an open position and that movement of the movable contact to its closed position causes loading of the opening spring. In the closed position, the movable contact is latched in position by the opening and closing sub-assembly controlled by the opening latch. The energy storage sub-assembly is then uncoupled from the contacts so that it is possible to move the energy storage spring to its loaded state by means of a manual or motorized drive mechanism, whereas the switchgear apparatus remains closed, and then to keep the energy storage spring in the loaded position by means of the closing latch. From this apparatus closed, energy storage sub-assembly loaded position, a contact opening, contact closing, contact re-opening (OCO) sequence can be executed without having to perform an intermediate reloading sequence, by successively commanding unlatching of the opening latch, unlatching of the closing latch, and then unlatching of the opening latch again.

In order to be able to fit the energy storage spring simply, the control sub-assembly is equipped with a removable telescopic means wherein the energy storage spring is inserted, and with a cotter-pin enabling the telescopic means and the spring to be locked in a compressed position thus allowing the telescopic means and the spring chosen to be fitted and removed as a single part. A whole range of different closing springs can thus be provided, corresponding to different closing energies, able to be fitted on the same telescopic means, which enables a whole switchgear range to be achieved from a single standard mechanism.

The choice of the energy storage spring does however remain limited by the space available in the mechanism for the spring. When the energy of the mechanism is to be increased beyond what is allowed by the available space, a new mechanism has to be created deduced from the previous one by homothetic transformation.

To increase the power available, it can naturally also be envisaged to abut two identical mechanisms. However such a solution assumes that two operating mechanisms coexist, which gives rise to coordination problems, in particular as far as the opening latches and closing latches are concerned. In addition, among the duplicated parts, many of them are of no use.

In the document FR 2,683,089, it has been proposed to couple to a standard main drive mechanism able to drive on its own the three poles of a three-phase circuit breaker, an auxiliary mechanism dedicated to a fourth pole, so as to constitute a four-pole assembly. The contacts of the auxiliary pole are coupled to a rotary switching bar by means of contact pressure springs. The auxiliary mechanism comprises an auxiliary spring which, in the closed position of the bar, exerts a torque on the bar opposing the torque resulting from the contact pressure springs. The auxiliary spring only acts on the bar when the latter is positioned between an intermediate load take-up position and the closed position, these two positions being close to one another. On the other hand, when the bar is between the open position and the intermediate loading position, the auxiliary spring no longer acts on the bar. Such a mechanism provides a solution when the contact pressure exerted on the contact fingers has to be increased. It does not on the other hand enable the force exerted at the beginning of closing, that conditions the initial power and acceleration of the mechanism and the time required to perform the closing operation, to be increased.

SUMMARY OF THE INVENTION

The object of the invention is therefore to remedy the shortcomings of the state of the art so as to increase the closing energy of a circuit breaker mechanism while reducing the modifications of the existing mechanism to the minimum.

According to the invention, this problem is solved by means of a closing assistance mechanism for an electrical switchgear apparatus, comprising:

- a switching shaft movable in rotation in a closing direction from an open position to a closed position, and in an opening direction opposite to the closing direction, from the closed position to the open position;
- a closing assistance spring, movable between an unloaded position and a loaded position;
- a loading shaft movable in rotation in a loading direction;
- loading means associated to the loading shaft to drive the closing assistance spring from the unloaded position to the loaded position when the loading shaft rotates in the loading direction to a ready to close position and to release the closing assistance spring when the loading shaft goes beyond the ready to close position in the loading direction;
- transmission and coupling means comprising:
  - a driving coupling means in permanent kinematic connection with the closing assistance spring,
  - a driven coupling means securedly affixed to the switching shaft, the driven coupling means following a rotary trajectory in the closing direction when the switching shaft moves from the open position to the closed position, and in the opening direction when the switching shaft moves from the closed position to the open position;
  - a return means of the driving coupling means;
- the transmission and coupling means being such that:
  - when the switching shaft is in the open position and the closing assistance spring is in the loaded position, the driving coupling means is in a load takeup position, engaged with the driven coupling means;
  - when the closing assistance spring moves from the loaded position to the unloaded position, the driving coupling means drives the driven coupling means to an intermediate uncoupled position, and the switching shaft moves from the open position to an intermediate uncoupled position in the closing direction;

when the switching shaft moves from the uncoupled position to the closed position in the closing direction, the driving coupling means is driven to a withdrawn position by the return means and the driven coupling means is uncoupled from the driving coupling means;

when the closing assistance spring moves from the unloaded position to the loaded position, the driving coupling means moves from the withdrawn position to the load take-up position following a trajectory not interfering with the rotary trajectory of the driven coupling means.

The closing assistance mechanism is very simple since it comprises neither a closing latch nor an opening latch, operation thereof being achieved by rotation of the loading shaft. The closing assistance spring enables at least a part of the energy required for closing to be communicated to the switching shaft.

Advantageously, the loading means and the transmission and coupling means have in common a multifunctional lever pivoting between a loaded position and an unloaded position around a fixed geometric axis, operating in conjunction with a loading cam securedly affixed to the loading shaft, with the closing assistance spring, and with the driving means in such a way that:

when the multifunctional lever pivots from the unloaded position to the loaded position due to the bias of the loading cam when rotation of the loading shaft takes place, the multifunctional lever drives the closing assistance spring from the unloaded position to the loaded position and drives the driving means from the withdrawn position to the load take-up position;

when the multifunctional lever pivots from the loaded position to the unloaded position due to the bias of the closing assistance spring moving from the loaded position to the unloaded position, the multifunctional lever drives the driving means from the load take-up position to the intermediate uncoupled position.

The multifunctional lever enables the mechanism to be achieved with few parts.

According to one embodiment, a first of the driving and driven coupling means comprise a pin, and a second of the driving and driven coupling means comprise a hook having a shape such that:

when the switching shaft is between the open position and the uncoupled position, the pin is held by the hook and, when the switching shaft goes past the uncoupled position in the closing direction, the pin escapes from the hook due to the bias of the return means.

Coupling is then achieved in a particularly simple and rugged manner. Other coupling means can naturally be envisaged.

Preferably the return means comprise a return spring.

According to one embodiment, the transmission and coupling means comprise in addition: a coupling cam securedly affixed to the loading shaft, operating in conjunction with the driving coupling means when the driving coupling means move from the withdrawn position to the load take-up position.

The invention also relates to a drive mechanism associating a main mechanism controlled by a closing latch and an opening latch, with a closing assistance mechanism as described previously. The main mechanism comprises an energy storage spring which alone has to provide at least the energy necessary to drive the switching shaft from the intermediate uncoupled position to the closed position.

BRIEF DESCRIPTION OF THE DRAWINGS

Other advantages and features of the invention will become more clearly apparent from the following description of a particular embodiment of the invention given as a non-restrictive example only and represented in the accompanying drawings in which.

DETAILED DESCRIPTION OF A PREFERRED EMBODIMENT

Figure 1:
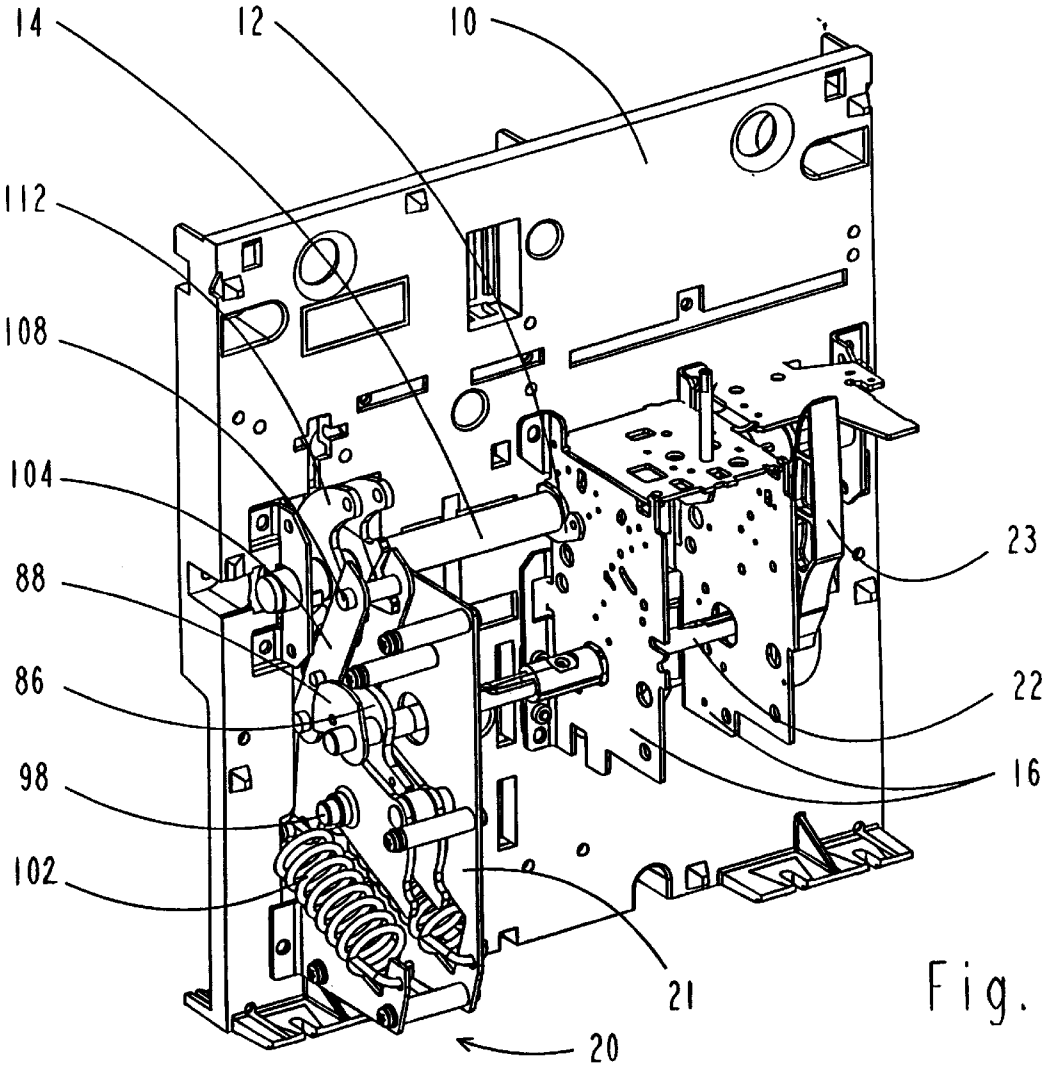
FIG. 1 represents an intermediate support frame of a switching shaft of a drive mechanism according to the invention.

An intermediate plate 10 of a circuit breaker support frame is represented in FIG. 1. Bearings 12 enable a switching shaft 14 to be supported in rotation with respect to the frame 10 between an open position and a closed position. This switching shaft 14 is connected by a kinematic transmission system to at least one pair of separable contacts (not represented) of the circuit breaker so as to drive this pair of contacts between a separated position, corresponding to the open position of the shaft, and a contact position corresponding to the closed position of the shaft. The plate 10 also supports two lateral support flanges 16 of a main drive mechanism of the circuit breaker switching shaft (represented in FIGS. 2 to 4, but purposely omitted in FIG. 1 in order not to complicate reading), and a closing assistance mechanism 20 fitted between a right-hand lateral flange 21 and a left-hand lateral flange (the latter flange having been purposely omitted in the figure). The flanges also enable a loading shaft 22 driven by a crank 23 to be supported. The main drive mechanism is of the type described in the document FR 2,589,626 and comprises an energy storage sub-assembly and an opening and closing sub-assembly.

Figure 2:
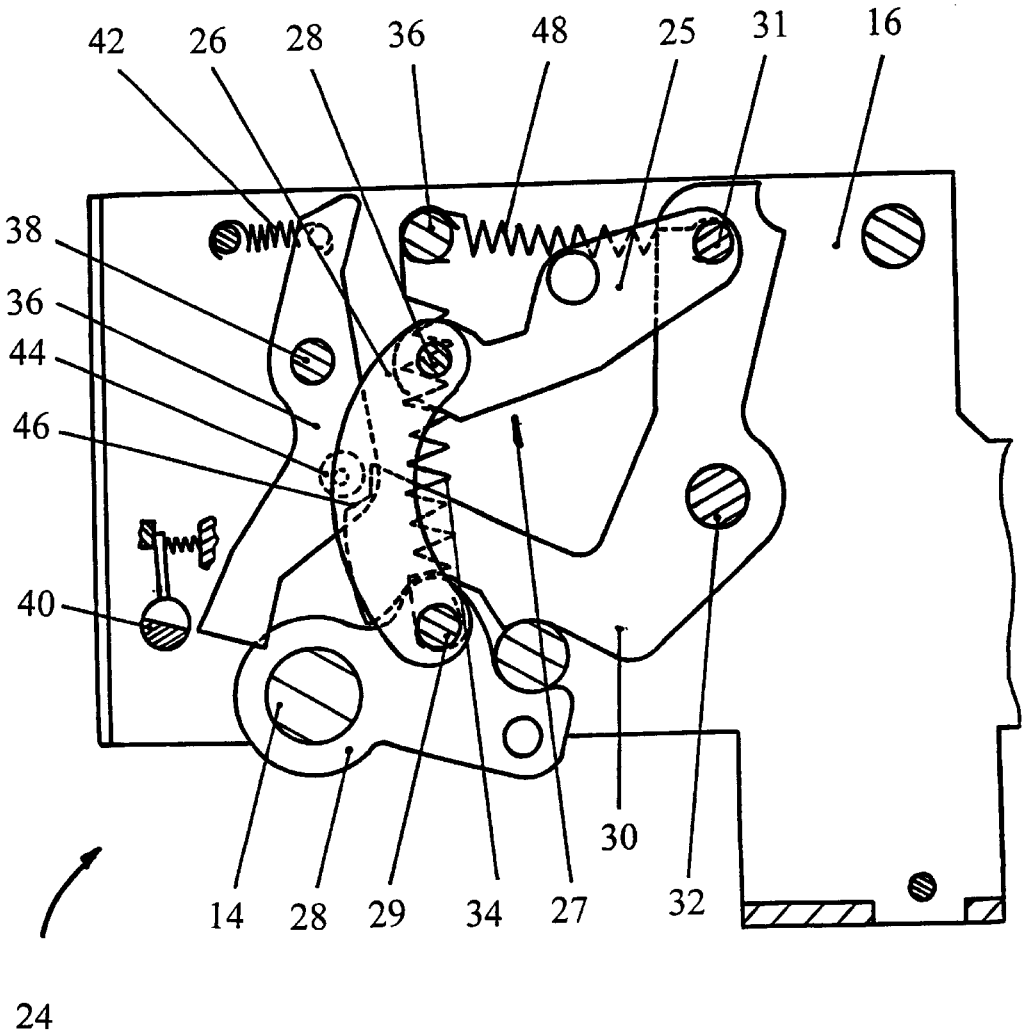
FIG. 2 represents an opening and closing sub-assembly of the drive mechanism of FIG. 1.

The opening and closing sub-assembly 24, represented in FIG. 2 in an open position, comprises a toggle mechanism 27 with two rods 25, 26 articulated on one another by a pivoting spindle 28. The rod 26 is mechanically coupled to a crank 28 of the switching shaft 14 by means of a pin 29. The other rod 25 is articulated in rotation by a spindle 31 on a tripping hook 30 pivotally mounted on a fixed spindle 32. An opening spring 34 is secured between the pin 29 of the crank 28 and a fixed holding cleat 36, and tends to return the crank 28 to its open position, counterclockwise in FIG. 2. An opening latch 36 formed by a lever pivoting around a fixed spindle 38 is controlled by an opening latch 40 in the form of a half-moon. The latch 36 is biased counterclockwise by a spring 42, forcing it away from the half-moon 40 and towards the hook 30. The opening latch 40 is biased elastically to its latched position where it opposes rotation of the latch 36. A roller 44 arranged on the opening latch 36 between the ends thereof operates in conjunction with a V-shaped recess 46 of the tripping hook 30. The hook 30 is biased by a spring 48 counterclockwise in the figure, tending to shorten the distance between the articulation spindle 31 of the toggle mechanism on the hook 30 and the articulation spindle 29 of the toggle mechanism on the crank 28.

Figure 3:
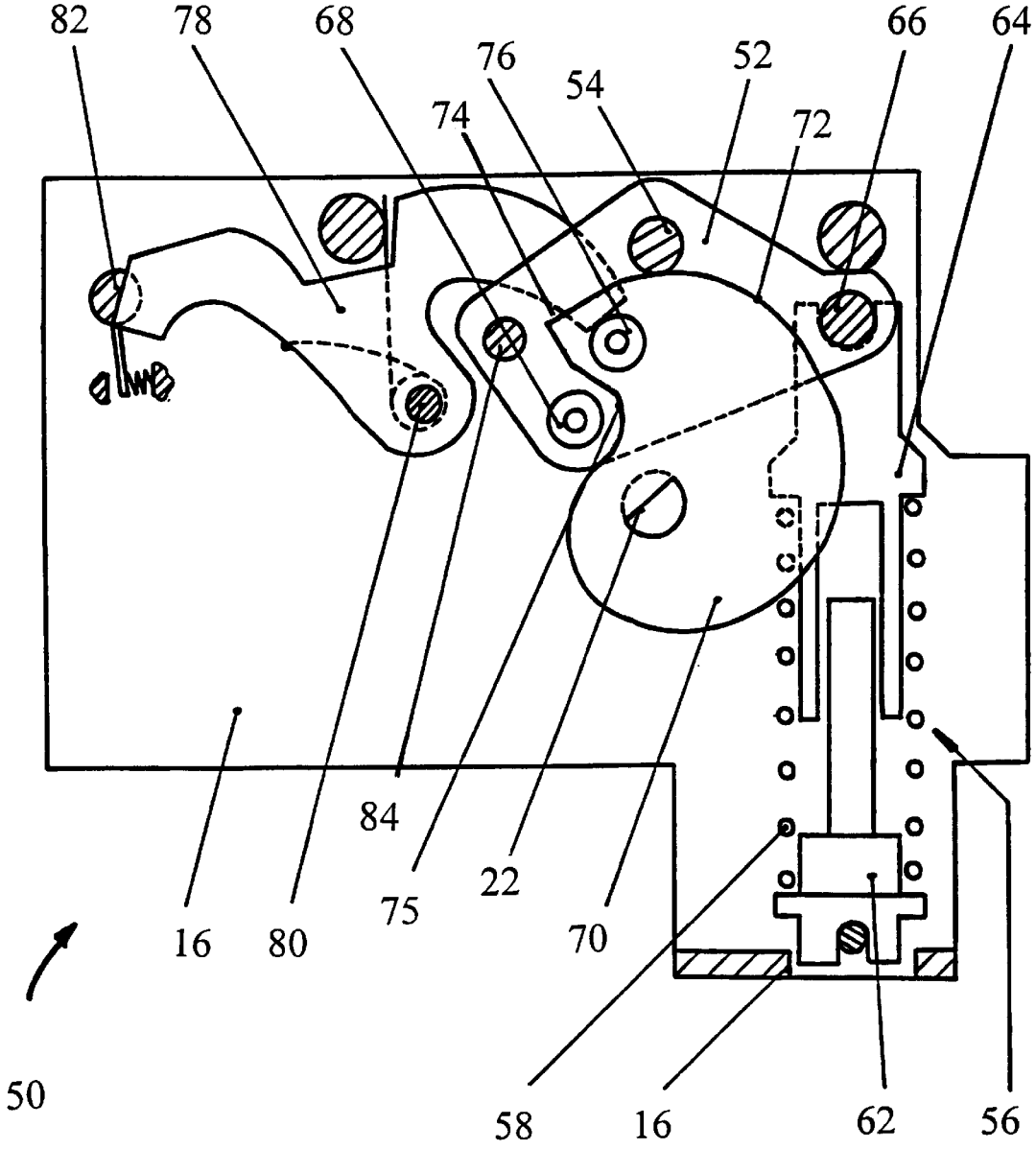
FIG. 3 represents an energy storage sub-assembly of the drive mechanism of FIG. 1, in the unloaded position.

The energy storage sub-assembly 50 is represented in FIG. 3 in its unloaded state. A drive lever 52 is pivotally mounted around a fixed spindle 54. A flexible potential energy storage device 56 comprises an energy storage spring 58 inserted in a telescopic guiding system comprising a guide 62 pivotally mounted on a fixed spindle and a slide rack 64 sliding with respect to the guide 62 and pivoting with respect to a pin 66 securedly united to the drive lever 52. The drive lever 52 also bears a roller 68 operating in conjunction with a loading cam 70 keyed onto the loading shaft 22. The shaft 22 is designed to rotate in a loading direction only, i.e. clockwise in the figures. If required, a free-wheel can be provided to prevent any counterclockwise rotation of the shaft. The loading cam 70 comprises a driving pad 72 and a receiving pad 74, operating in conjunction with the roller 68, and a withdrawn pad 75. The cam 70 is also equipped with a roller 76 designed to operate in conjunction with a closing latch 78 that is pivotally mounted around a fixed spindle 80. A rotary closing latch 82 in the form of a half-moon enables the latch 78 to be latched in the position of FIG. 4. This latch is biased elastically to its closed position. The latch 78 is itself biased clockwise by a spring to its latched position represented in FIG. 4. The closing latch 82 thus enables the cam to be latched in the position of FIG. 4 by means of the latch 78 and the roller 76, which form a gearing-down stage.

A link between the opening and closing sub-assembly 24 and the energy storage sub-assembly 50 is achieved by a finger 84 securedly affixed to the drive lever 52 and designed to operate in conjunction with the toggle mechanism of the opening and closing sub-assembly 24, this finger 84 extending according to an axis essentially perpendicular to the planes of the flanges 16. The opening and closing sub-assembly 24 and the energy storage sub-assembly 50 are both provided with end of travel stops visible in the figures.

As can be seen in FIG. 1, the closing assistance mechanism 20 is arranged in the extension of the main drive mechanism so as to be able to operate in conjunction with the switching shaft 14 and with the loading shaft 22.

Figure 5:
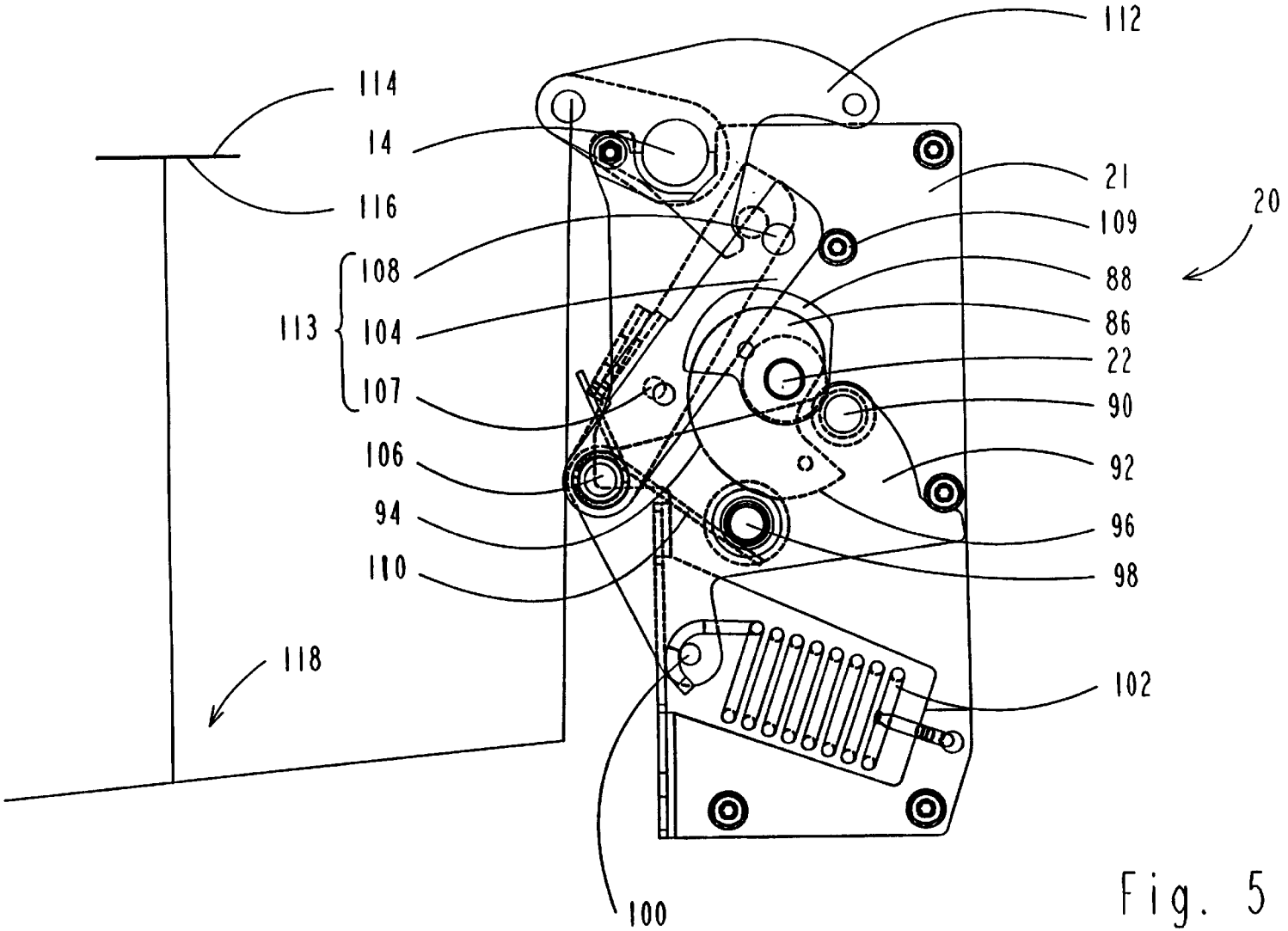
FIG. 5 represents a closing assistance mechanism of the drive mechanism of FIG. 1, in the unloaded position.
Figure 6:
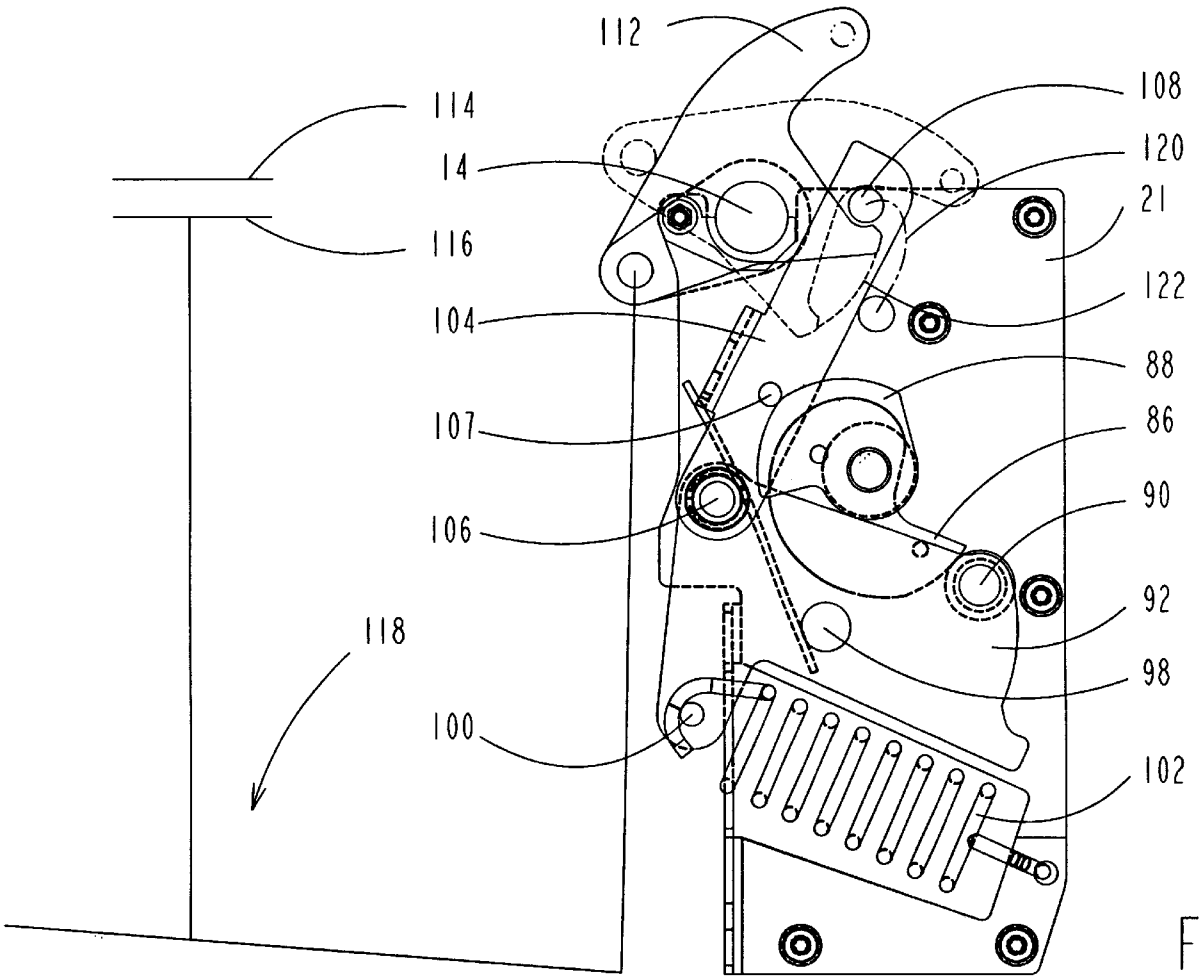
FIG. 6 represents the closing assistance mechanism, in the loaded position.

In FIGS. 5 and 6, a loading cam 86 and a coupling cam 88 can be seen keyed onto the loading shaft 22. The loading cam 86 operates in conjunction with a roller 90 fitted on a multifunctional lever 92. It has a drive pad 94 and a receiving pad 96. The multifunctional lever 92 pivots around a fixed spindle 98 between an unloaded position (FIG. 5) and a loaded position (FIG. 6) and is provided with a fixing peg 100 securing one end of a closing assistance spring 102 the other end whereof is fixed with respect to the flange 21. A transmission arm 104 is also articulated on the multifunctional lever 92 by means of a pivot 106. The arm 104 is provided with a positioning pin 106 operating in conjunction with the coupling cam 88 and with a securing pin 108. The arm is biased clockwise in the figures to a withdrawn position represented in an unbroken line in FIG. 5, in which position the arm 104 is pressing against a stop 109. The switching shaft 14 is equipped with a transmission crank 112 in the form of a hook, acting as driven transmission means, operating in conjunction with the securing pin 108 which forms a driving transmission means 113 with the arm 104 and pin 106. In FIG. 6, the crank has been represented by an unbroken line in a position corresponding to the open position of the switching shaft and by a broken line in a position corresponding to the closed position of the switching shaft. A stationary contact 114 of the circuit breaker, and a movable contact 116 connected to the switching shaft 14 by a kinematic system 118 have also been schematically represented.

The assistance mechanism 20 thus described operates as a slave mechanism of the main mechanism that then constitutes a master mechanism.

Operation of the main mechanism is described step by step in the document FR 2,589,626 which should be referred to for further details. It should be recalled here that the energy storage sub-assembly 50 performs cycles comprising a loading phase followed by an impulsive relaxation phase.

Figure 4:
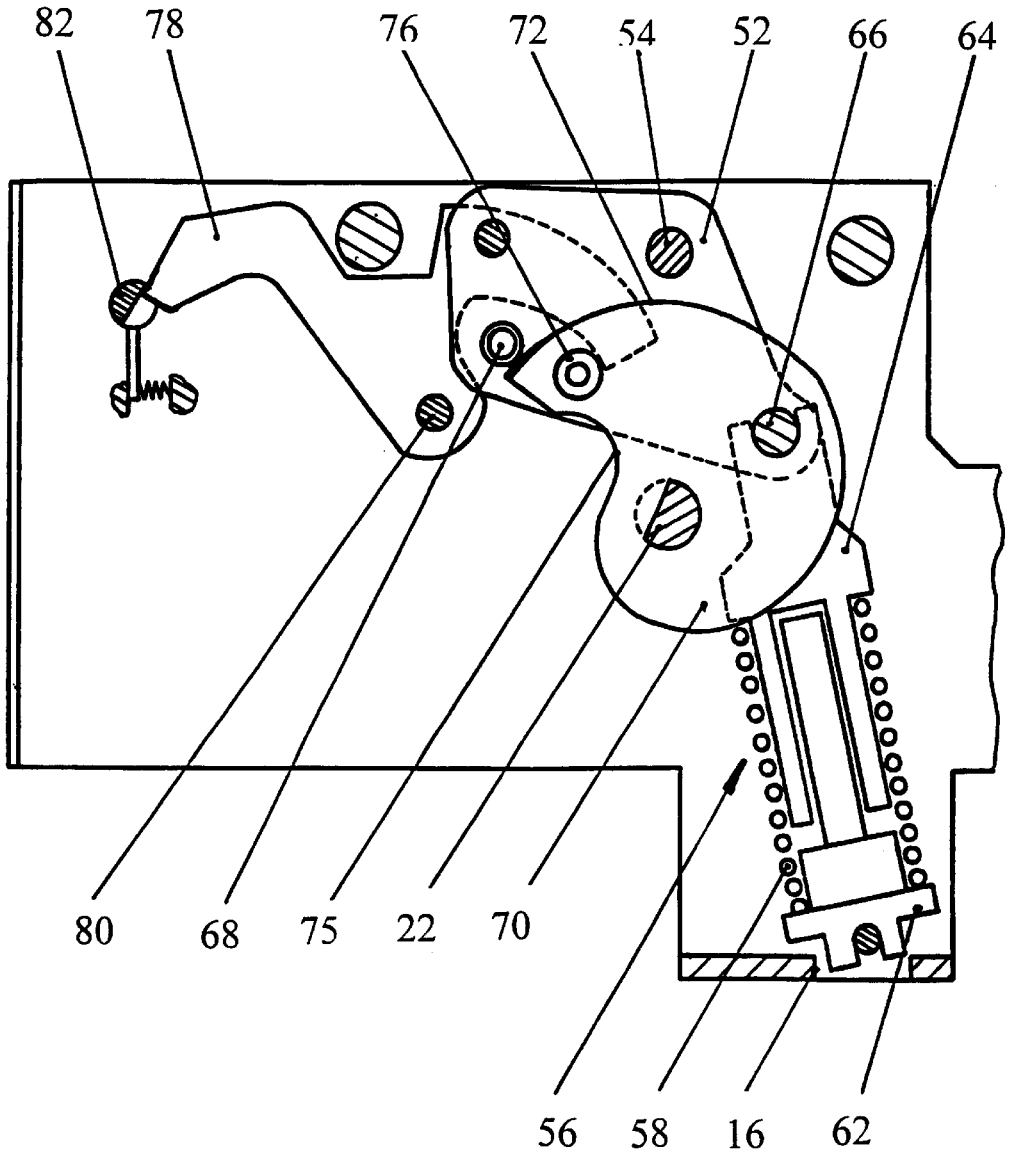
FIG. 4 represents the energy storage sub-assembly of the drive mechanism of FIG. 1, in the loaded position.

During the loading phase, the energy storage sub-assembly 50 moves from the unloaded position represented in FIG. 3 to the loaded position represented in FIG. 4. The drive shaft 22 is driven by the crank 23 clockwise in the figures, and the driving pad 72 of the loading cam 70 operates in conjunction with the roller 54 of the drive lever 52 so as to compress the energy storage spring 58. When the roller 54 comes into contact with the receiving pad 74, it tends to drive the loading shaft 22 itself. The roller 76 of the loading cam 70 then bears on the hook 52 that is latched in position by the closing latch 82. The position obtained, represented in FIG. 4, is stable.

During the loading phase, the assistance mechanism 20 follows the movement of the main mechanism and moves from the position represented in FIG. 5 to the position represented in FIG. 6. The loading cam 86 of the assistance mechanism is identical to the loading cam 70 of the master mechanism and in phase with the latter, so that its driving pad 94 operates in conjunction with the roller 90 of the multifunctional lever 92 so as to make the lever 92 pivot clockwise and compress the assistance spring 102, before becoming a receiver, under the same conditions as the loading cam. The mechanism stops in the position of FIG. 6, when the closing latch 82 of the energy storage sub-assembly 50 of the master mechanism latches the loading shaft 22 in the loaded position.

During the loading phase, pivoting of the multifunctional lever 92 also has the effect of driving the transmission arm 104. The return spring 10 imposes on the arm 104 a position such that the pin 106 is taken up by the coupling cam 88. The latter is shaped in such a way that the securing pin 108 follows a curved trajectory 120, represented in FIG. 6, that does not interfere with the trajectory of the crank 122 between the open position and the closed position of the switching shaft 14.

This lack of interference enables the loading procedure to be rendered independent from the position of the switching shaft 14. The switching shaft can be in the closed or open position. An opening order can moreover take place during the reloading phase of the mechanism. Whatever the position of the switching shaft 14, care is taken that the securing pin 108 is not on the trajectory of the transmission crank 112 so that the crank 112 does not hamper the movement of the pin 108 and the pin 108 does not hamper movement of the switching shaft 14.

The impulsive relaxation phase begins by clearing of the closing latch 82 of the master mechanism following a closing order. As soon as the latch 78 has been released, the drive lever 52 pivots around its spindle 54 so that the finger 84 follows a counterclockwise arc of a circle trajectory.

If the opening and closing sub-assembly 24 is in the open position at the beginning of the impulsive relaxation phase of the energy storage sub-assembly 50, the finger 84 drives the rods 25, 26 of the toggle mechanism beyond a dead point until the opening and closing sub-assembly 24 reaches a stable position, latched by the opening latch 40. The switching shaft 14 is driven by the toggle mechanism from the open position of the contacts to the closed position of the contacts covering an angle of 55° counterclockwise in FIGS. 2, 5 and 6.

During this closing phase the slave mechanism 20 follows the movement of the master mechanism and assists this movement. As soon as the closing latch 82 of the master mechanism has been unlatched, the closing assistance spring 102 of the assistance mechanism 20 drives the multifunctional lever 92 counterclockwise which has the effect of ejecting the loading cam 86 and of biasing the arm 104 in traction. The arm 104 acts as a connecting rod and drives the crank with which it is engaged clockwise. Just before it reaches the closed position of the contacts, the switching shaft 14 passes fleetingly via an intermediate uncoupled position corresponding to an end of travel position of the multifunctional lever. The switching shaft 14 continues its rotation to the closed position biased by the master mechanism and the hooked crank 112 releases the pin 108 that is then in the position represented in a broken line in FIG. 5. The arm 104 then pivots clockwise due to the bias of its return spring 110 until the positioning pin 106 presses up against the stop 109 in the position represented by the unbroken line in FIG. 5. The slave mechanism 20 is then in the unloaded position of FIG. 5.

Opening of the mechanism is controlled by the opening latch 40. As soon as the latter releases the tripping hook 36, the opening spring 34 drives the rods 25, 26 and the switching shaft 14 pivots counterclockwise to return to the open position. This movement is independent of the position of the main mechanism that can be either in the unloaded position, in the course of reloading, or in the loaded position, as the transmission finger 84 does not prevent the opening movement. Likewise, opening is not hampered by the presence of the closing assistance mechanism 20 whatever the position of the latter, due to the absence of interference between the curved trajectory 120 of the coupling pin 108 and the circular trajectory of the crank 112 between the closed position and the open position.

Various modifications are naturally possible.

The switching shaft and/or loading shaft can be achieved in two parts—a section of main shaft for the master mechanism and an extension section for the assistance mechanism 20. This enables differentiation of the switchgear to be postponed and the assistance mechanism to be rendered purely optional. It may on the other hand be preferable to manufacture the switching shaft and/or loading shaft in a single part, if the number of apparatuses produced justifies it.

In the embodiment, the multi functional lever performs both the kinematic link between the loading shaft and the closing assistance spring and the kinematic link between the closing assistance spring and the coupling means 113. This multifunctional lever can however be replaced by two distinct means, one dedicated to linking the loading shaft and the spring in the loading phase, and the other dedicated to linking the assistance spring and the coupling means 113.

The hook/pin link can be reversed. It can also be replaced by any other type of link enabling uncoupling when the switching shaft goes beyond a given position.

What is claimed is:

1. A closing assistance mechanism for an electrical switchgear apparatus, comprising:

a switching shaft movable in rotation in a closing direction from an open position to a closed position, and in an opening direction opposite to the closing direction, from the closed position to the open position;

a closing assistance spring movable between an unloaded position and a loaded position;

a loading shaft movable in rotation in a loading direction;

loading means associated to the loading shaft to drive the closing assistance spring from the unloaded position to the loaded position when the loading shaft rotates in the loading direction to a ready to close position and to release the closing assistance spring when the loading shaft goes beyond the ready to close position in the loading direction;

transmission and coupling means comprising:

a driving coupling means in permanent kinematic connection with the closing assistance spring, a driven coupling means securedly affixed to the switching shaft, the driven coupling means following a rotary trajectory in the closing direction when the switching shaft moves from the open position to the closed position, and in the opening direction when the switching shaft moves from the closed position to the open position;

a return means of the driving coupling means;

the transmission and coupling means being such that:

when the switching shaft is in the open position and the closing assistance spring is in the loaded position, the driving coupling means is in a load take-up position, engaged with the driven coupling means;

when the closing assistance spring moves from the loaded position to the unloaded position, the driving coupling means drives the driven coupling means to an intermediate uncoupled position, and the switching shaft moves from the open position to an intermediate uncoupled position in the closing direction;

when the switching shaft moves from the uncoupled position to the closed position in the closing direction, the driving coupling means is driven to a withdrawn position by the return means and the driven coupling means is uncoupled from the driving coupling means;

when the closing assistance spring moves from the unloaded position to the loaded position, the driving coupling means moves from the withdrawn position to the load take-up position following a trajectory not interfering with the rotary trajectory of the driven coupling means.

2. The mechanism according to claim 1, wherein the loading means and the transmission and coupling means have in common a multifunctional lever pivoting between a loaded position and an unloaded position around a fixed geometric axis, operating in conjunction with a loading cam securedly affixed to the loading shaft, with the closing assistance spring, and with the driving means in such a way that:

when the multifunctional lever pivots from the unloaded position to the loaded position due to the bias of the loading cam when rotation of the loading shaft takes place, the multifunctional lever drives the closing assistance spring from the unloaded position to the loaded position and drives the driving means from the withdrawn position to the load take-up position;

when the multifunctional lever pivots from the loaded position to the unloaded position due to the bias of the closing assistance spring moving from the loaded position to the unloaded position, the multifunctional lever drives the driving means from the load take-up position to the intermediate uncoupled position.

3. The mechanism according to claim 1, wherein a first of the driving and driven coupling means comprise a pin, and a second of the driving and driven coupling means comprise a hook having a shape such that:

when the switching shaft is between the open position and the uncoupled position, the pin is held by the hook and, when the switching shaft goes past the uncoupled position in the closing direction, the pin escapes from the hook due to the bias of the return means.

4. The mechanism according to claim 1, wherein the return means comprise a return spring.

5. The mechanism according to claim 1, wherein the transmission and coupling means comprise in addition: a coupling cam securedly affixed to the loading shaft, operating in conjunction with the driving coupling means when the driving coupling means moves from the withdrawn position to the load take-up position.

6. A drive mechanism of an electrical switchgear apparatus, comprising:

a switching shaft movable in rotation in a closing direction from an open position to a closed position, and in an opening direction opposite to the closing direction, from the closed position to the open position;

a loading shaft movable in rotation in a loading direction;

a main energy storage sub-assembly comprising:

an energy storage spring associated to the switching shaft in such a way that relaxation of the energy storage spring drives the switching shaft to the closed position;

main loading means associated to the loading shaft to drive the energy storage spring to a loaded ready to close state when the loading shaft rotates in the loading direction to a ready to close position and to release the energy storage spring when the loading shaft goes beyond the ready to close position in the loading direction;

a closing latch designed to latch the loading shaft in the ready to close position and the energy storage spring in the loaded ready to close state;

an opening and closing sub-assembly comprising:

an opening spring associated to the switching shaft in such a way that relaxation of the opening spring drives the switching shaft to an open position and that movement of the switching shaft to the closed position results in loading of the opening spring, and an opening latch designed to latch the opening spring in a loaded ready to open state;

comprising in addition:

a closing assistance mechanism comprising:

a closing assistance spring movable between an unloaded position and a loaded position;

auxiliary loading means associated to the loading shaft to drive the closing assistance spring from the unloaded position to the loaded position when the loading shaft rotates in the loading direction to the ready to close position and to release the closing assistance spring when the loading shaft goes beyond the ready to close position in the loading direction;

transmission and coupling means comprising:

a driving coupling means in permanent kinematic connection with the closing assistance spring, a driven coupling means securedly affixed to the switching shaft, the driven coupling means following a rotary trajectory in the closing direction when the switching shaft moves from the open position to the closed position, and in the opening direction when the switching shaft moves from the closed position to the open position;

a return means of the driving coupling means;

the transmission and coupling means being such that:

when the switching shaft is in the open position and the closing assistance spring is in the loaded position, the driving coupling means is in a load take-up position, engaged with the driven coupling means;

when the closing assistance spring moves from the loaded position to the unloaded position, the driving coupling means drives the driven coupling means to an intermediate uncoupled position, and the switching shaft moves from the open position to an intermediate uncoupled position in the closing direction;

when the switching shaft moves from the uncoupled position to the closed position in the closing direction, the driving coupling means is driven to a withdrawn position by the return means and the driven coupling means is uncoupled from the driving coupling means;

when the closing assistance spring moves from the unloaded position to the loaded position, the driving coupling means moves from the withdrawn position to the load take-up position following a trajectory not interfering with the rotary trajectory of the driven coupling means.

7. The mechanism according to claim 6, wherein the loading means and the transmission and coupling means have in common a multifunctional lever pivoting between a loaded position and an unloaded position around a fixed geometric axis, operating in conjunction with a loading cam securedly affixed to the loading shaft, with the closing assistance spring, and with the driving means in such a way that:

when the multifunctional lever pivots from the unloaded position to the loaded position due to the bias of the loading cam when rotation of the loading shaft takes place, the multifunctional lever drives the closing assistance spring from the unloaded position to the loaded position and drives the driving means from the withdrawn position to the load take-up position;

when the multifunctional lever pivots from the loaded position to the unloaded position due to the bias of the closing assistance spring moving from the loaded position to the unloaded position, the multifunctional lever drives the driving means from the load take-up position to the intermediate uncoupled position.

8. The mechanism according to claim 6, wherein a first of the driving and driven coupling means comprise a pin, and a second of the driving and driven coupling means comprise a hook having a shape such that:

when the switching shaft is between the open position and the uncoupled position, the pin is held by the hook and, when the switching shaft goes past the uncoupled position in the closing direction, the pin escapes from the hook due to the bias of the return means.

9. The mechanism according to claim 6, wherein the return means comprise a return spring.

10. The mechanism according to claim 1, wherein the transmission and coupling means comprise in addition: a coupling cam securedly affixed to the loading shaft, operating in conjunction with the driving coupling means when the driving coupling means moves from the withdrawn position to the load take-up position.

* * * * *